United States Patent [19]

Fassbinder et al.

[11] Patent Number: 4,789,139

[45] Date of Patent: Dec. 6, 1988

[54] METHODS OF AND APPARATUS FOR CONSTRUCTING REFRACTORY BRICK LININGS ON TUYERE PLATES FOR METAL TREATING VESSELS

[75] Inventors: Hans G. Fassbinder, Sulzbach-Rosenberg; Paul G. Mantey, Amberg, both of Fed. Rep. of Germany

[73] Assignee: Eisenwerk-Gesellschaft Maximillanshutte, Sulzbach-Rosenberg, Fed. Rep. of Germany

[21] Appl. No.: 855,590

[22] Filed: Nov. 29, 1977

[30] Foreign Application Priority Data

Nov. 30, 1976 [DE] Fed. Rep. of Germany ..... 26542325

[51] Int. Cl.[4] ..... C21C 5/48

[52] U.S. Cl. ..... 266/221; 156/71; 266/217; 266/220; 266/224

[58] Field of Search ..... 266/221, 224, 217, 220; 156/71

[56] References Cited

U.S. PATENT DOCUMENTS

| | | | |
|---|---|---|---|
| 1,376,935 | 5/1921 | Griggs | 266/281 X |
| 2,456,798 | 12/1948 | Slick | 266/224 |
| 3,287,875 | 11/1966 | Lakin | 52/747 |
| 3,810,297 | 5/1974 | Fisher | 266/224 X |
| 3,944,083 | 3/1976 | Fisher et al. | 266/224 X |
| 4,023,781 | 5/1977 | Fritz et al. | 266/281 X |
| 4,396,179 | 8/1983 | Labate | 266/220 |
| 4,538,795 | 9/1985 | Labate | 266/220 |

*Primary Examiner*—Peter D. Rosenberg
*Attorney, Agent, or Firm*—Lawrence I. Field

[57] ABSTRACT

A method of constructing a refractory brick lining on a bottom tuyere plate for a vessel for refining or otherwise treating a metal melt comprises the improvement of constructing the lining in an imperforate manner on the bottom tuyere plate and then drilling tuyere ducts in the lining. The brick lining is preferably constructed with the bottom tuyere plate in an upright position and the ducts are then drilled while the plate and the lining are still upright. The bottom tuyere plate is preferably mounted in an assembly frame which is itself pivotally mounted to enable the frame together with the bottom tuyere plate to be swung from a horizontal position to the upright position.

11 Claims, 1 Drawing Sheet

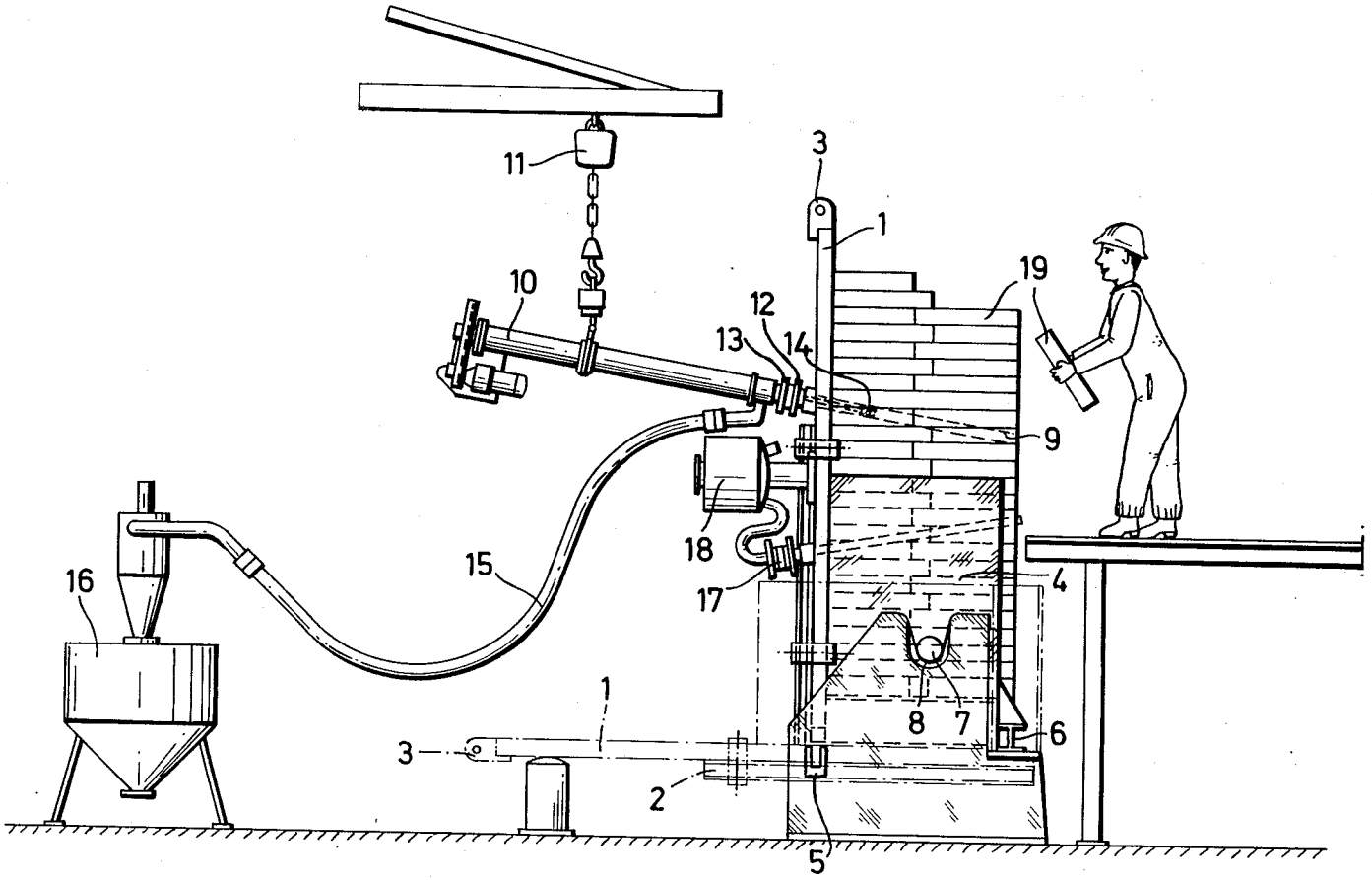
1
2
3
4
5
6
7
8
9
10
11
12
13
14
15
16
17
18
19

METHODS OF AND APPARATUS FOR CONSTRUCTING REFRACTORY BRICK LININGS ON TUYERE PLATES FOR METAL TREATING VESSELS

This invention relates to methods of and apparatus for constructing refractory brick linings on tuyere plates of vessels for treating, and in particular refining, metal melts.

Oxygen or other gas-blown refining vessels comprise tuyeres which extend through refractory brickwork linings of the vessels. Refining gas and sometimes other gases are blown through the tuyeres into a melt in the vessel. The tuyeres, for example bottom tuyeres, must be tightly and firmly joined into the refractory brick lining. A simple method of embedding the tuyeres in a refractory brick lining and of connecting them to the brickwork consists of ramming or casting a refractory material around the tuyeres and between the tuyere and surrounding bricks of the lining. This material does indeed have the advantage of being simple to use, but in most cases no satisfactory refractory material of a plastic consistency is available which possesses the same durability as refractory bricks with which metallurgical vessels are usually lined.

In another method of surrounding the tuyeres and fitting them to the brickwork lining shaped bricks are used. These are built round the tuyeres as the lining is constructed. Particularly at fairly high temperatures and where the attack from the melt and slag is severe, e.g. in steel refining vessels such as converters for the production of steel, shaped bricks are almost exclusively used for the lining surrounding the tuyere. The tuyere surround should, with this lining, bond into as uniformly as possible the remainder of the brickwork lining.

A large variety of shaped bricks are known, which enable the majority of tubular tuyeres to be tightly surrounded. The external, rectangular dimensions of these shaped bricks ensure a good bond into the courses of brickes of the vessel lining. Also, from German Specification No. 2,522,036, shaped bricks are known, by which obliquely extending tuyeres can be surrounded with the shaped bricks being adapted to the remainder of the brickwork.

The aforementioned methods of fitting the tuyeres to the vessel lining have, however, resulted in a number of disadvantages. While the use of refractory mixtures leads to premature wear, the adapting of the shaped bricks to fit into the vessel lining necessitates additional work in respect of the building-in time and correct jointing with the surrounding courses of brickwork. The unavoidable changes in the built-in positions of the tuyeres as a result of deformations in the tuyere plate of the metal treatment vessels inevitably make the installation of specially shaped bricks difficult.

Deformations of the tuyere plate and other metal structure, by which the tuyeres are normally fixed in the desired position, must be expected in metal treatment vessels simply because of the operating temperatures involved. For example, the tuyere plates of bottom oxygen-blown steel converters, in which refining oxygen and a protective medium are blown through the melt via tuyeres in the converter bottom, become distorted after fairly long use. Depending upon the size of the converter, in one particular layout there are from about 8 to 20 partly inclined tuyeres in the converter bottom. The tuyeres are fixed in position by flanges on the plate. The refractory lining, consisting of shaped bricks around the tuyeres and conventional bricks, is next laid upon the bottom plate. As the operating time of the vessel increases, however, the bottom plate is subjected to deformations which bring about changes of the tuyere positions within certain limits. To form a refractory brick lining on a distorted bottom plate, considerable aligning and cutting operations on the bricks are necessary in order to construct the entire bottom with the necessary close-fitting brick joints.

The aim of the present invention is to overcome the disadvantages described above while retaining the advantages of a complete bottom lining of refractory bricks and in particular to provide a method, which will ensure that a brick lining for the bottom tuyere plates of metal refining vessels with close-fitting joints can be constructed economically. The method also allows for accurate adapting of the brick lining to the tuyeres while taking into account the changing positions of the tuyeres owing to distortion of the tuyere plates over a period of time.

To this end, according to this invention, we provide a method of constructing a refractory brick lining on a bottom tuyere plate for a vessel for refining or otherwise treating metal melts, wherein an imperforate lining is first constructed on the bottom tuyere plate and then tuyere ducts are formed in the lining.

The tuyere ducts are preferably formed by drilling.

For the purpose of constructing the lining, the bottom plate may be situated in an assembly frame. The bottom plate can be disposed horizontally and the brickwork is then placed on the bottom plate in one or more layers. This can be done with or without mortar or other jointing material. In order to attain high strength in the bottom lining, the use of an organic two-component adhesive, containing a filler proportion of 70%, the filler being the same as the material of which the bricks are made, has been practised with success. For example, when laying magnesite bricks, magnesite dust is added as filler to the organic two-component adhesive. The filler normally has a higher proportion of flux than the brick material itself, in order to ensure a ceramic solidification as soon as possible after the organic constituents of the jointing material have vaporised.

After the bottom lining has been constructed and the jointing material has hardened to a certain extent, the tuyere ducts are formed. When the bottom plate is horizontal, a drilling machine may be fixed to tuyere flanges beneath the bottom tuyere plate, in order to ensure accurate guiding of the drill in the desired direction of the tuyere. Where the drilling machine operates with compressed air cooling, the compressed air may also convey the drilling dust out of the bored tuyere duct. Core drills with diamond or hard metal cutters have proved satisfactory. Since this type of drill necessitates withdrawal of the drilled cores and thus an additional operation, solid bits with annular diamond cutters or hard metal cutters are preferably used.

With the bottom plate horizontal, drilling takes place substantially vertically, that is upwards. Where the tuyere ducts are inclined, the direction of drilling deviates from the vertical. During drilling, the bottom plate together with the lining remains upon the assembly frame or is mounted on an assembly frame which has the necessary clearance beneath it and is provided with safety devices.

It has been found advantageous in the method in accordance with the invention, to set up the bottom plate at an inclination, both for laying the bottom bricks and also for drilling the tuyere ducts. For this purpose, the bottom plate is first of all fixed in an assembly frame with a tilting device, which permits rotation of the bottom plate from a horizontal position to a vertical position. A holding device is preferably provided on the assembly frame to hold the bottom plate in the desired operating position and secure the movable components, that is the assembly frame and the bottom plate, to prevent sliding out of the lining. Hydraulic cylinders or electric motors with associated gears may be used for tilting the assembly frame. Normally available lifting equipment, such as a mobile crane and in particular an overhead crane, has also proved to be completely satisfactory and to form an economical mechanism for tilting the assembly frame.

An assembly frame without its own drive, which is pivoted into the desired position by a lifting device such as an overhead crane, requires only a suitable arresting or holding device such as bolts, wedges or struts, in order to hold and secure the frame, together with the bottom plate, in the desired position for the construction and subsequent drilling of the brick lining.

For laying the bottom bricks where the bottom plate is inclined, the assembly frame may be equipped with a template, which corresponds to the peripheral shape of the bottom. This template may consist basically of a rigid metal sheet bent to a semicircle, which extends perpendicularly to the bottom plate. The template can also be of other forms according to its purpose, for example it may consist of a smaller arc of a circle or may be made from a grating or mesh instead of metal sheet. The template may be formed as a unit with the tilting frame.

The bricks are laid in the template when this is provided. This technique provides the advantage for the lining of the bottom of operating simply and with joints of minimum dimensions. The individual bricks do not stand on the bottom plate, as when the bottom plate is horizontal, and therefore do not need to be pressed against one another in order to obtain close joints, but they fit close together in courses under the influence of gravity when the bottom plate is inclined, for example at 60° or more to the horizontal. With this inclination, there is sufficient working space on the flange side of the bottom plate for the drilling team and the drilling machine for drilling the tuyere ducts.

Constructing the lining and drilling with the bottom plate vertical has proved especially advantageous. With the bottom plate in this position, the described advantages of the inclined bottom plate can be realised very satisfactory. Moreover, further improvements in the setting up and locking of the bottom plate, the laying of the bricks and the drilling of the tuyere ducts are obtained.

When bringing the bottom plate into an upright position, for example by the use of an overhead crane, it is possible in a simple manner to swing the assembly frame together with the bottom plate and the brickwork template as far as a stop which prevents the plate and frame moving past a vertical position. The locking of the assembly frame with the bottom, can also be effected without problems in this position, for example by inserting wedges into counter-pieces on a bearing frame and the assembly frame, by removing a pivotal bearing of the assembly frame and lowering the frame into a suitable holding piece for the trunnions or by lifting the frame as it swings upwards and inserting support chocks.

When the bottom bricks are laid in a single, but preferably two or more layers, the vertical position of the bottom plate offers particular advantages. The bricks are then laid in horizontal courses and the layers can be bonded side by side. This permits accurate control and inspection and reliable placing with close joints. Auxiliary devices, for example walk-ways for workmen and material can be brought up close to the location of placing and thus the vertical location of the bottom plate contributes to a reduction in the time required for lining, facilitates the bricklaying work and promotes working safety.

The drilling of the tuyere ducts, when the bottom plate is vertical, takes place approximately horizontally or deviating from the horizontal by the tuyere inclination. This position of the bottom plate considerably simplifies the drilling operations; the drilling time required is shorter than that where the drill is in a vertical or near vertical position and thus the entire drilling operation is more economical. Walk-ways for the drilling team and an auxiliary crane for handling the drilling machine can be used.

An example of a method and of an apparatus in accordance with the invention will now be described with reference to the accompanying drawing which is a diagrammatic side view of the operation of lining the bottom of a 60 t bottom oxygen-blown converter.

A bottom plate 1 of the converter is initially mounted in an assembly frame 2 in a horizontal position. The horizontal position is indicated in the drawing in chain-dotted lines. Then, using an overhead crane, not shown, which is connected to a lifting eye 3, the assembly frame 2 together with the bottom plate 1 and a brickwork template 4 is tilted into a vertical position and is held in this position by a locking device 5. The co-operative action of the locking device 5 and a support 6 on the assembly frame 2 lift a bearing trunnion 7 out of its seating 8 when the bottom plate 1 reaches the vertical position. Consequently, an accurately adjusted position of the bottom plate 1 in the vertical direction and also a reliable upright position, which prevents unintentional sliding of the frame 2, the bottom plate 1 and the template 4, are obtained.

When the assembly frame 2 is lowered back into its horizontal position after completion of the lining including tuyeres in the bottom, the locking device 5 is removed. For this purpose, the overhead crane must first of all lift the plate 1 slightly. During the subsequent lowering of the assembly frame 2, the trunnion 7 returns into its seating 8, and an inclination of the frame into the desired lowering direction is ensured by the support 6. In this way, unintentional rotation of the frame in the wrong direction is avoided in a simple manner.

As soon as the bottom plate is situated in the locked, vertical position, laying of lining bricks 19 commences, in the present case as a two-layer brick lining with a bonding overlap in the middle. The template 4 acts here as an erection aid and boundary for the external contour of the bottom. It has been found in practice to be of advantage to omit entirely or partially the lower courses of brick, consisting of up to 10 bricks, when the bottom plate is being lined in the vertical position, and only to introduce them later, after the bottom lining and the bottom plate and lining have been completed and removed from the frame 2. This procedure offers the advantage that the bricklaying work commences in the template on a horizontal erection plate, that is a plate extending perpendicularly to the bottom plate, and thus optimum starting conditions are obtained for forming the bottom lining with close joints.

The bottom lining bricks in this example are 500 mm and 425 mm long with a cross-section of 100×150 mm and are of a low-iron, tar-bonded, annealed magnesite. For the entire bottom of 2.5 m in diameter, 15 t of bricks are necessary. The bricks are bonded together with an organic two-component adhesive, which contains about 70% magnesite dust as filler. After the adhesive has set, the bottom lining has high strength and tight joints. The bottom lining then behaves structurally like a monolithic block.

The lining operation takes about ten hours, and after a hardening time for the adhesive of about a further ten hours, drilling of tuyere ducts 9 commences. For this purpose, a drilling machine 10 is brought up by an auxiliary crane 11 to a nozzle flange 12 of the bottom plate 1. The drilling machine is equipped with a corresponding counter-flange 13, which is screwed to the tuyere flange 12. This ensures that the bore 9 is accurately aligned axially with the tuyere pipes which are installed later. The drilling machine has a hard metal solid bit 14 with an annular cutter which is equipped with compressed air cooling, the air supply line for which is not shown. The drillings in the form of brick powder are removed by the compressed air stream through a line 15 and are separated in a cyclone 16. The drilling time for one tuyere duct is about five minutes.

After the tuyere ducts, of which there are ten in this example, have been drilled, tuyere pipes 17 together with a lime distributor 18 and all feed and supply lines are mounted on the bottom plate 1. As soon as the bottom, including the tuyeres and the associates supply lines has been completed, the whole bottom is swung back into a horizontal position and the brickwork in the lower segmental section of the bottom is completed to finish the bottom.

It is within the scope of this invention to erect the refractory brick lining of the bottom directly in the refining vessel, for example in the converter and likewise to drill the tuyere ducts with the bottom plate mounted on the refining vessel. The use of the method in accordance with the present invention in this way is of especial advantage when the bottom lining wears away at the same rate as the sidewall refractory lining of the converter and thus it is unnecessary to change the bottom alone. Instead the entire lining of the converter can be constructed in one continuous operation.

We claim:

1. A method of installing a gas conducting insert in a refractory wall of a vessel such that a gas may be introduced through the insert into the interior of the vessel, said method comprising:

providing a bore through said wall by drilling said bore in said refractory wall, after the construction of said refractory wall, and at a specifically preferred location;

fixing a tube having therethrough a cylindrical passageway within said bore in a gas tight manner; and fitting a gas conducting insert within said passage.

2. A method for introducing gas through a refractory wall of a vessel and into the interior of said vessel, said method comprising:

providing a bore through said refractory wall by drilling said bore in said refractory wall, after construction of said refractory wall, and at a specifically preferred location;

fixing a tube having therethrough a cylindrical passage within said bore in a gas tight manner;

fitting a gas conducting insert within said passage; and introducing gas into the outer end of said tube, such that said gas passes through said insert and into the interior of said vessel.

3. The method of claim 1 wherein said refractory wall is a refractory brick bottom lining on a bottom tuyere plate of a vessel for treating metal melts and said bore is a tuyere duct.

4. A method as claimed in claim 3, further comprising the step of supporting said bottom tuyere plate in a horizontal position and constructing said brick bottom lining while said tuyere plate is in said horizontal position.

5. A method as claimed in claim 1, further comprising the step of supporting said bottom tuyere plate in a vertical position and constructing said brick bottom lining while said plate is in said vertical position.

6. A method as claimed in claim 1, in which said bore is drilled through said lining while said bottom tuyere plate and said lining are in a vertical position.

7. A method as claimed in claim 3, further comprising the step of fixing a drilling machine to tuyere flanges projecting from said bottom tuyere plate on the face thereof remote from said lining and operating said drilling machine to drill said tuyere duct.

8. A method as claimed in claim 3, in which said bore is drilled by using a drilling bit selected from the group consisting of solid drilling bits with annular diamond cutters, diamond core bits and hard metal core bits.

9. Apparatus for constructing an imperforate refractory brick bottom lining on a bottom tuyere plate for a vessel for treating a metal melt, said apparatus comprising: an assembly frame for holding said bottom tuyere plate, means supporting said assembly frame in a position for the construction of said lining on said plate, and means for drilling tuyere ducts through said imperforate refractory brick bottom lining formed on said tuyere plate;

wherein said means for supporting said assembly frame includes pivotal mounting means, means for pivoting said assembly frame to move said bottom plate from a horizontal position into a vertical position and a locking device for securing said frame in a position in which said bottom plate is in said vertical position.

10. Apparatus as claimed in claim 9, further comprising template means for supporting said lining, and means fixing said template means to said assembly frame.

11. Apparatus as claimed in claim 9, wherein said means for pivoting said assembly frame includes power driving means.

* * * * *